United States Patent [19]

Steinmetz

[11] Patent Number: 4,799,813

[45] Date of Patent: Jan. 24, 1989

[54] COUPLING, ESPECIALLY FOR AN APPARATUS FOR FEEDING RECORDING CARRIERS TO THE PLATEN OF AN OFFICE MACHINE AND APPARATUS WITH SUCH COUPLINGS

[75] Inventor: Rene Steinmetz, Uetikon am See, Switzerland

[73] Assignee: Rutishauser Data AG, Stafa, Switzerland

[21] Appl. No.: 932,103

[22] Filed: Nov. 18, 1986

[30] Foreign Application Priority Data

Nov. 19, 1985 [CH] Switzerland ..... 04933/85

[51] Int. Cl.[4] ..... B41J 11/58; B41J 13/10

[52] U.S. Cl. ..... 400/629; 271/9; 400/624

[58] Field of Search ..... 400/569, 624, 625, 629; 271/9

[56] References Cited

U.S. PATENT DOCUMENTS

| | | | |
|---|---|---|---|
| 4,248,415 | 2/1981 | Steinhilber | 271/9 |
| 4,475,731 | 10/1984 | Wood | 271/9 |
| 4,570,919 | 2/1986 | Huang | 271/9 |
| 4,620,809 | 11/1986 | Runzi | 271/9 X |

FOREIGN PATENT DOCUMENTS

| | | | |
|---|---|---|---|
| 2950707 | 9/1980 | Fed. Rep. of Germany | 271/9 |

*Primary Examiner*—Paul T. Sewell

*Attorney, Agent, or Firm*—Cushman, Darby & Cushman

[57] ABSTRACT

A coupling (12) to be operated between a platen (16) and a sheet separating arrangement (18) may be triggered by the reversal of the direction of rotation of the platen (16) in order to produce a driving connection from the platen (16) to the separating arrangement (18). The drive at the same time takes place as a result of a reverse rotation through a predetermined rotational angle and a subsequent forward rotation. In order, however, to make possible also a backward rotation of the platen without any triggering of the couling, said coupling has camming discs (40, 44) one of which serves for the production of the driving connection by engagement of one driver and the other for the prevention of an engagement of the driver, whenever the platen is turned backward beyond the predetermined angle of rotation. The prevention of coupling which is caused thereby, produces the freedom of rotating the platen forward and backward for the production of a graphic presentation on the sheet.

14 Claims, 5 Drawing Sheets

COUPLING, ESPECIALLY FOR AN APPARATUS FOR FEEDING RECORDING CARRIERS TO THE PLATEN OF AN OFFICE MACHINE AND APPARATUS WITH SUCH COUPLINGS

BACKGROUND

The invention relates to a coupling according to the definition of the species of claim 1 and an apparatus with a multiplicity of such couplings.

The recording carriers may be, for example, individual sheets or also envelopes and they are designated subsequently only as sheets for the sake of simplicity. Customarily, a separating arrangement has at least a separating roller engaging with frictional contact at the stack of sheets and, as is well known, serves also for feeding the sheets right into the pulling in gap of the platen. An arrangement containing such couplings is intended for being placed onto an office machine, for example, a typewriter or an automatic writing device such as a printer, and is driven by the drive of the platen. The platen at the same time is coupled with a reversible drive, whereby the direction of rotation of the platen is designated as a forward rotational direction in the pulling-in direction of the sheet and the opposite rotational direction as a reverse rotational direction. The rotational directions mentioned in the case of the explanation of the coupling correspond to those of the platen.

A coupling of the type mentioned has been known from the German Patent No. 29 50 707. As connecting elements for coupling, this known coupling has a stop lever between the driver and the output shaft, a control disc, a driver peg disposed on the control disc, a driver disc and an idler wheel connected with it. If one takes into consideration that the idler wheel also consists of a number of individual parts, then the expenditure of connecting elements is relatively great. Despite such an expenditure, this known coupling is not suitable for the printing of graphic presentations, in the case of which the platen has to be turned forward and backward for the purpose of the process of recording, because the coupling would engage anew, for example, after a turn in the backward direction.

The apparatus known from the publication cited furthermore has the disadvantage that a three time reversal of the platen is necessary in order to drive the separating arrangement after the third reversal during a return run of the platen. As a result of such a function, the fed in sheet may not be pulled in by the platen during the feeding in process so that it is held up at the input gap of the platen and is arched as a result of the forward movement of the separating apparatus. Only by a further reversing of the platen into the forward rotational direction will the sheet be transported by the platen.

SUMMARY OF THE INVENTION

The invention has the object of creating a coupling of the initially mentioned type, however, in a simple and space-saving embodiment, which without engaging will permit a backward rotation over several revolutions. Especially, the coupling is supposed to be suitable for plotting and its diameter should not depend on the number of rotations possible in a backward rotational direction. Furthermore, an arrangement is to be created which is suitable for several magazines in the case of which the separating arrangement is driven after only twice a reversal of the platen during the forward movement.

The task set will be solved according to the invention by the features described herein.

The coupling according to the invention guarantees that in the case of a backward rotation beyond the predetermined rotational angle cited, a situation is created in which the driver causes no engagement so that the platen may be turned forward and backward for the production of a graphic presentation on the sheet.

In the case of a further embodiment, the arrangement of the latches is not only a member of the driving connection but it also replaces the overtake-free wheeling required in the case of the known embodiment. As a result of one embodiment, it is made possible for the driver to engage at the steep driver flanks for the production of a rotational direction and to come out again from the cutouts on the inclined end-flanks.

In the case of one embodiment, the first release cutout in the locking element serves in the same sense as the first driver cutout in the intermediate element for the establishment of a starting position by the driver for both elements. The steep driver flanks in the second release cutout of the locking element serve for carrying the locking element along in the reverse rotational direction. The inclined end-flank of the second release cutout serves for guiding the driver back into the direction of its starting position.

Another embodiment makes possible for the driver at least two full rotations in the backward direction, whereby in the case of each rotation, it shifts the locking element further by one step, and to be sure in a forward as well as in a backward direction of rotation. As a result of such an embodiment, it is possible, for example, to move the platen by a full length of sheet in the backward as well as in the forward direction of rotation without any drive of the coupling.

The present invention in one embodiment guarantees that the intermediate element may be turned at random in a forward direction in the case of the initial position of the driver without any driving connection to the output shaft.

One embodiment guarantees that always one of the three latches engages at a smaller division than the division of the toothing amounts to. As a result of that, an extremely small play is guaranteed in the case of the engagement of the latch arrangement.

One embodiment provides an advantageous construction of the coupling elements, whereby the friction of the gear element imposed on the remaining elements is small, however, there exists a frictional connection between the locking element and the intermediate element in order to guarantee the relative position established by the driver between the intermediate element and the locking element. The control element at the same time is freely rotatable between the elements adjoining on both sides within its functional area.

In the case of one embodiment, the gear element forms a jacket for the remaining coupling elements so that the latter are protected without an additional housing.

Further, the apparatus includes a multiplicity of couplings which make possible the selective feeding of, for example, sheets for letters and envelopes for letters from various magazines.

One embodiment of the arrangement guarantees an exact positioning of the fed in recording carriers at the pull-in gap of the platen.

In the case of a preferred embodiment, the couplings to be adjusted to variable, predetermined rotational angle have completely identical parts except for the locking element.

BRIEF DESCRIPTION OF THE DRAWINGS

An embodiment of the invention will be explained in more detail by way of example and on the basis of the drawing. There is shown in FIG. 1 a longitudinal cut through a coupling along the line of intersection I—I according to FIG. 2;

FIG. 8 like FIG. 7, however, after a reverse rotation beyond the rotational angle predetermined for coupling in;

DETAILED DESCRIPTION

Figure 1:
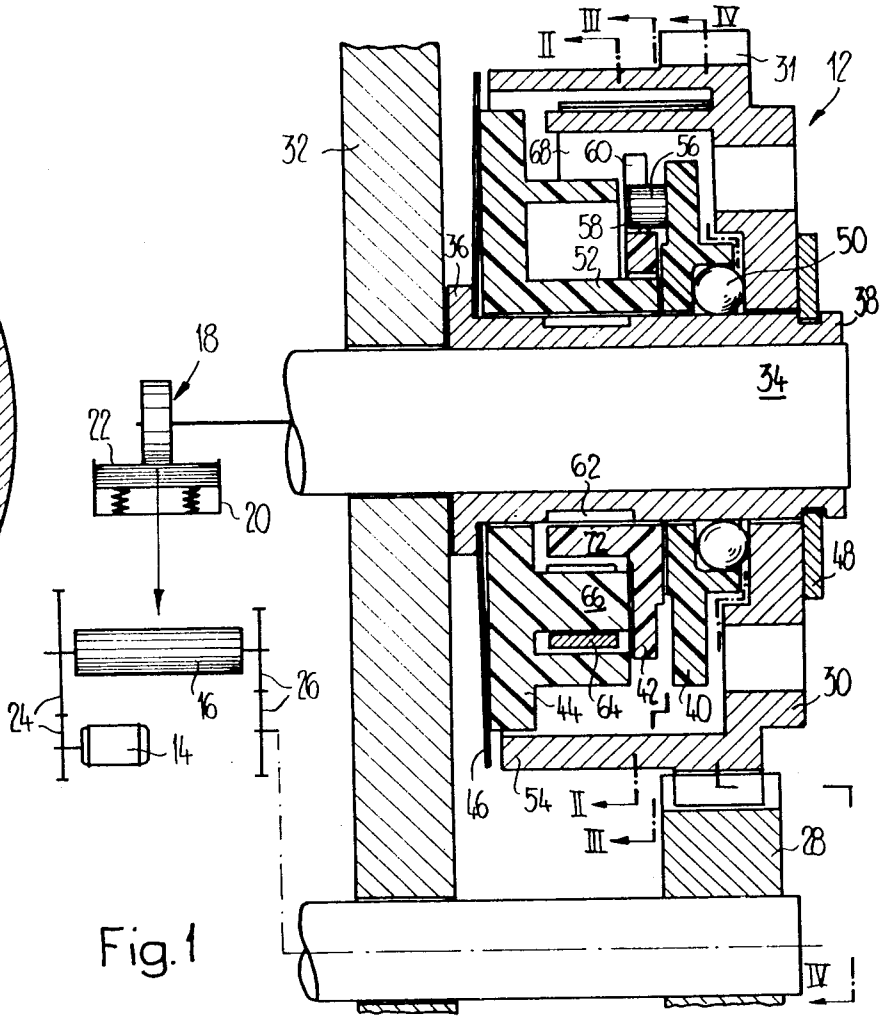

The coupling 12, shown in FIG. 1 in a longitudinal cut at an enlarged scale, serves for the selective establishment of a driving connection of a platen 16 which may be driven by a drive 14 to a separating arrangement 18 which is shown by way of a frictional wheel in order to feed the uppermost sheet of a stock 22 disposed in a magazine 20 to the platen. For establishing the driving connection of the platen 16 to the separating arrangement 18, the coupling may be coupled in and out by a reversal of the direction of rotation of the drive 14.

On the one hand, the platen 16 is connected by way of gear elements 24 with the drive 14 and on the other hand by way of gear elements 26 and 28 with the coupling 12. The driving element 28 is a pinion meshing with a gear 30 of the coupling 12.

The coupling 12 has an output shaft 34 mounted in a frame 32 and connected with torsional strength to the separating arrangement 18 as indicated. On the output shaft 34, a flange 36 having a hub 38 has been disposed (torsionally) to be rotatable with shaft 34, which hub serves as a carrier of the coupling elements.

The following elements are mounted on the hub 38 freely rotatable in sequence: the gear 30, a locking disc 40, a control disc 42 and a switching wheel 44. These elements are prestressed against a safety ring by a frictional spring disc 46 disposed on the hub 38. Between the gear 30 and the locking disc 40, a ball race 50 has been disposed for reducing the friction between these two elements. The switching wheel 44 has axial extensions 52 passing through the control disc 42, the front surfaces of which produce a frictional connection with the locking disc 40. The axial extensions 52 are provided as three pieces (FIG. 2) distributed evenly over the periphery of the hub 38, which pieces moreover serve as distancers so that the control disc 42 is mounted freely between the switching wheel 44 and the locking disc 40.

The gear 30 has a jacketshaped extension 54 with which it encloses the remaining elements of the coupling. On the locking disc 40, a peg 56 has been disposed which reaches into a recess 58 disposed on the control disc 42, so that the relative movement between the locking disc 40 and the control disc 42 is limited by the size of the recess 58. The recess 58 terminates with a stop surface 60.

In the hub 38, an annular recess 62 has been disposed on the periphery, which is intended for a driving connection in one direction of rotation provided by means of three latches mounted in the switching wheel 44, of which only the one latch 64 is shown in cross section. For its mounting, there is provided a peg 66 disposed on the switching wheel 44. On the part of the jacketshaped extension 54 of the gear 30 illustrated on top, there is provided a spring 68 which produces the prestress for one driver to be described in connection with FIG. 2.

Figure 2:
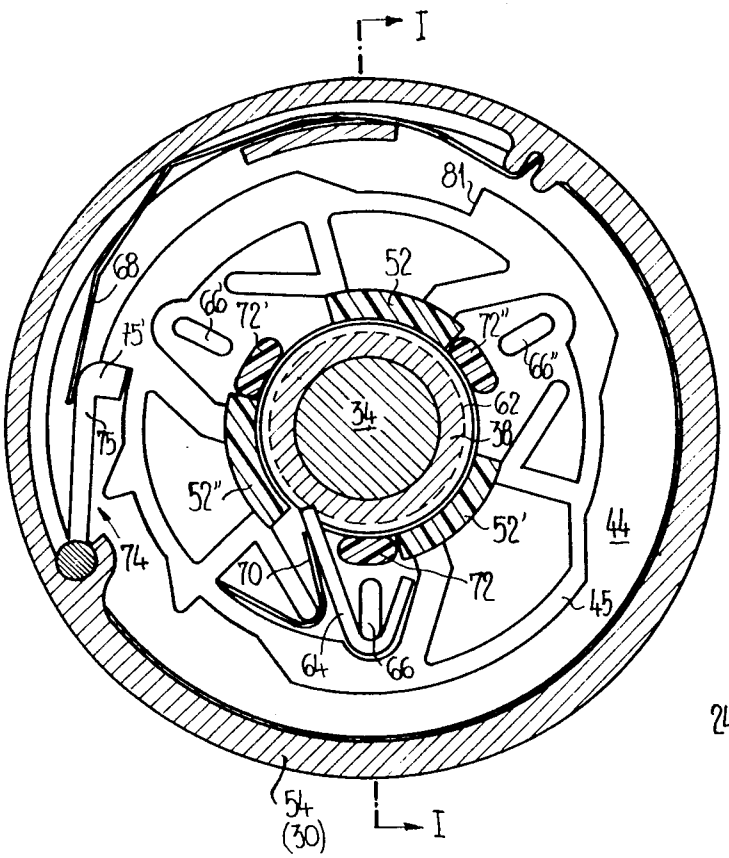
FIG. 2 a cross section through the coupling along the line of intersection II—II of FIG. 1.

In the cross section according to FIG. 2, the shaped surface 45 of the switching wheel 44 may be seen. Of this surface, only the three axial extensions 52, 52' and 52'' extend right through the cross sectional surface shown.

The latch 64 mounted around the bearing peg 66 engages at a point below the end of a leaf spring 70 into the recess 62 of the hub 38. Although only one latch 64 is shown in the simplified illustration according to FIG. 2, altogether three latches are disposed displaced by 12° one from the other of which the two, not shown, are mounted around the bearing pegs 66' and 66'', respectively. The arrangement of these latches 64 and the recess 62 are synchronized in such a way with regard to one another that always only one latch is in engagement in order to obtain thereby a more refined drive connection.

The latches 64 may be brought out of engagement from the recess 62 by the operating arms 72, 72' and 22'', whenever the operating arms extending in an axial direction are moved clockwise in relation to the switching wheel 44. The operating arms 72, 72' and 72'', according to FIG. 1, extend through the cross sectional surface of FIG. 2, starting from the control disc 42.

According to FIG. 2, the driver 74 being under the influence of the leaf spring 68 and which has already been mentioned, is mounted in- the jacketshaped extension 54 of the gear 30.

Figure 3:
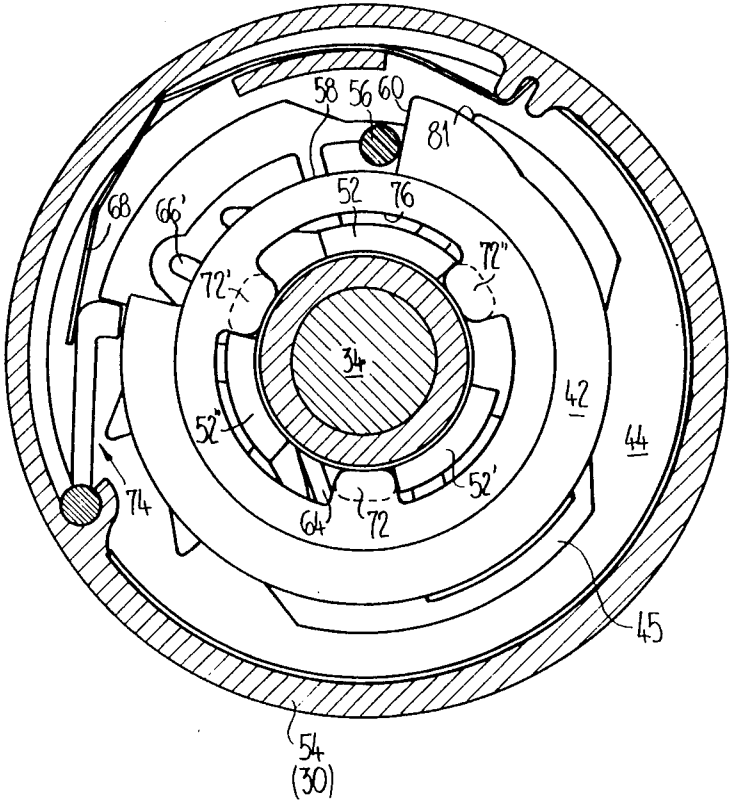
FIG. 3 a cross section through the coupling along the line of intersection III—III of FIG. 1.

The cross section according to FIG. 3 simultaneously represents an end view of the control disc 42. One may recognize especially from this figure that the axial extensions 52, 52' and 52'' of the shifting wheel 44 extend right through recesses 76 of the control disc 42 which recesses are the intervals between the three operating arms 72, 72' and 72''. Furthermore, one may recognize from FIG. 3 the depth of the recess 58 into which the peg 56 of the locking disc 40 projects.

From the FIG. 3 one may recognize furthermore the relative position between the stop surface 60 of the control disc 42 and of the flank 81 defining the starting position and located on the shifting wheel 44. The distance of the stop surface 60 from the flank 81 permits the control disc 42 to be displaced in relation to the starting position in the counterclockwise sense, so that the latches 64 are in engagement. Whenever the control disc 42 is turned clockwise to such a point at which its stop surface 60 lies in one plane with the flank 81 of the shifting wheel 44, then the latch 64 is out of engagement from the recess 62 because of contact with one of the operating arms. Such a state is brought about by the drive 74 whenever the latter has left its position as shown and is moved clockwise in the direction of the flank 81.

The depth of the recess 58 on the side of the periphery in the control disc 42 permits one to recognize the extent of play within which the peg 56 and with it, the locking disc 40, not shown in the FIG. 3, is movable.

Figure 4:
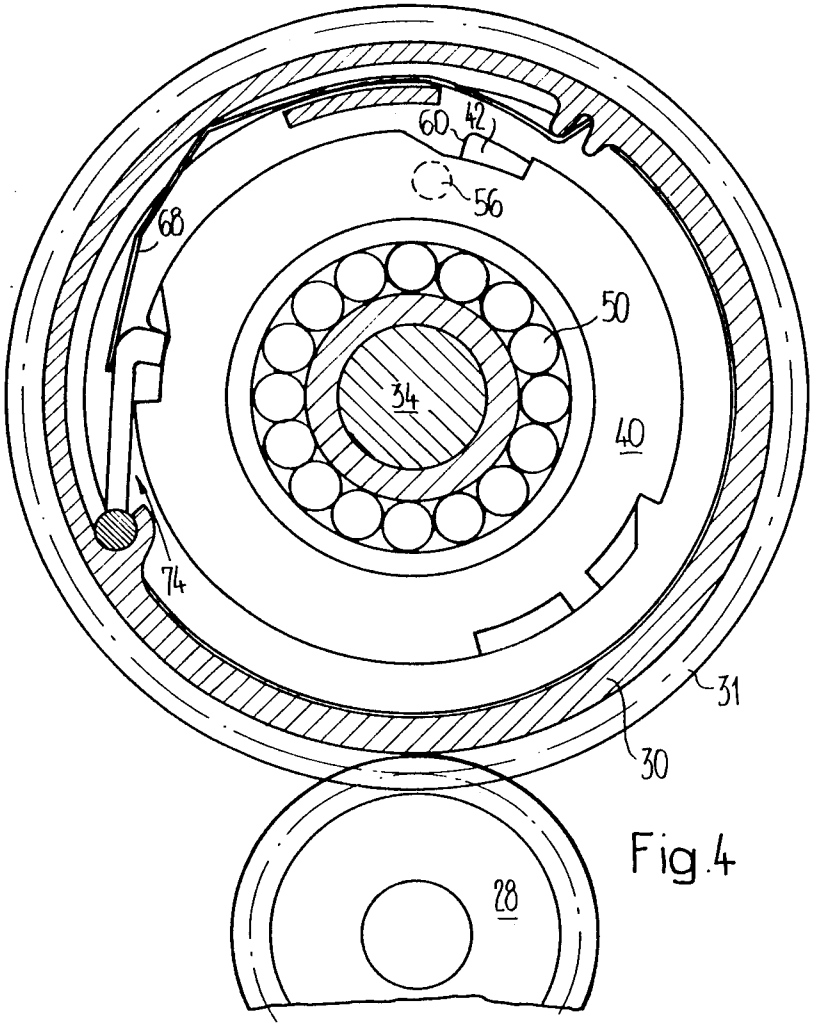
FIG. 4 a cross section through the coupling along the line of intersection IV—IV of FIG. 1.

In the cross section according to FIG. 4, there is shown an end view of the locking disc 40 with the inserted race of balls 50.

Figure 6:
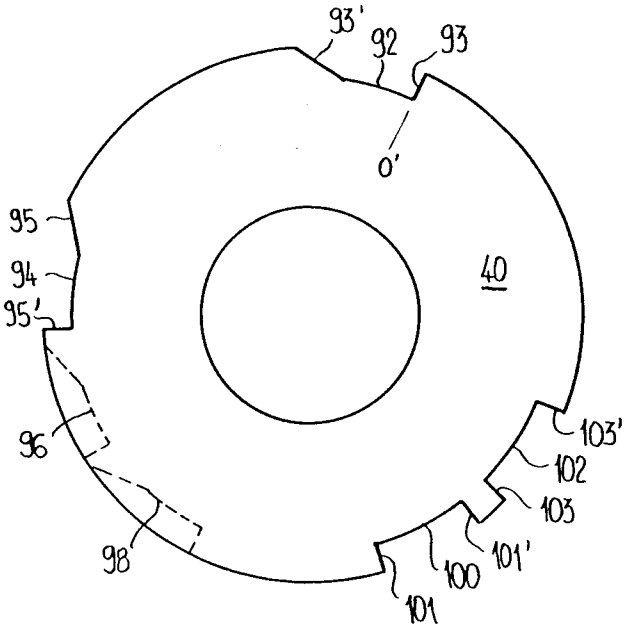
FIG. 6 the locking disc of the coupling.

For the explanation of the cooperation of the locking disc 40 with the shifting wheel 44, only the developments of the switching wheel or of the locking disc on the peripheral side will be explained essentially on the basis of the FIGS. 5 and 6. According to FIG. 5, the shifting wheel 44 designated as an intermediate element in the appended claims has a first driver cutout 80, a second driver cutout 82 as well as additional driver cutouts 84 and 86. The arrow 88 directed in a clockwise direction indicates the forward direction of rotation which corresponds to the pull-in direction of the sheet of the platen 16 shown in FIG. 1. The driver cutouts 80, 82, 84 and 86 have steep driver flanks 81, 83, 85 and 87 in the forward direction of rotation 88. The assigned and inclined end-flanks disposed in the backward direction of rotation are designated by 81', 83', 85' and 87'. The flank 81 at the same time corresponds to the starting position indicated in the FIG. 3.

The driver cutout 80 with its steep flank 81 serves for fixing a relative position between the lever driver 74 and the switching wheel 44. The second driver cutout 82 is displaced by a predetermined rotational angle as compared to the first driver cutout 80 and serves with its steep flank 83 for coupling the gear 30 to wheel 44. The additional driver cutouts 84 and 86 are located at different, predetermined rotational angles and are intended for producing individually controllable couplings in one and the same device, whenever for example recording carriers such as sheets of paper and envelopes are to be fed in selectively from various magazines to the platen. At the same time, however, only a single one of the driver cutouts 82, 84 or 86 is intended for each coupling. As will yet be explained, only that driver cutout is active which may be released by the locking disc.

Figure 5:
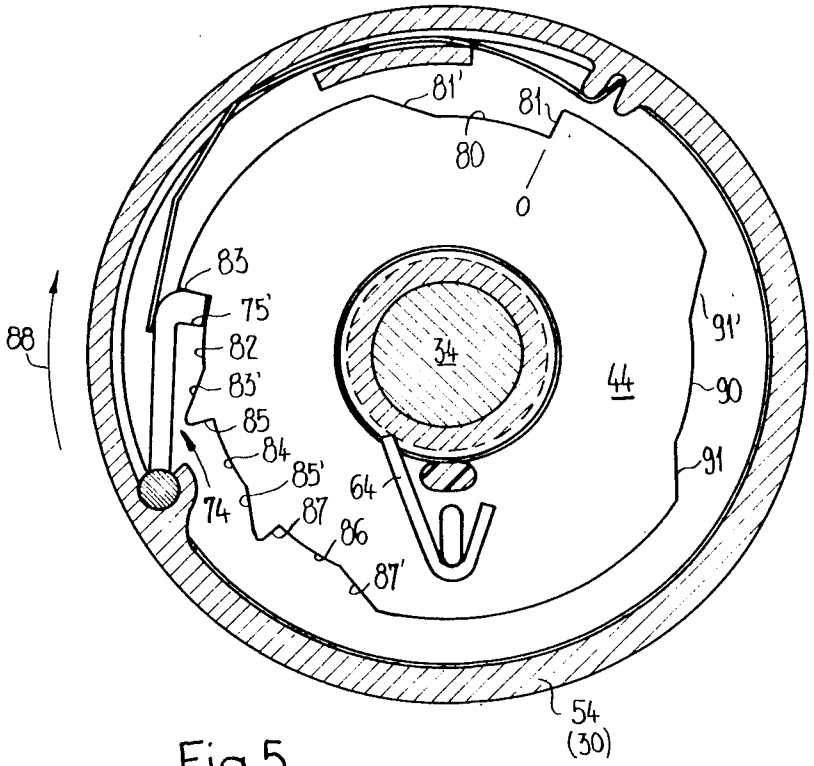
FIG. 5 a cross section for the illustration of the peripheral line of the switching wheel of the coupling.

From FIG. 5, one may recognize furthermore that the switching wheel 44 has an additional cutout 90 with flanks 91 and 91' inclined on both sides at a place which is displaced peripherally as against the cutouts described heretofore. The starting position of the shifting wheel 44 is designated with the line 0 in the FIG. 5. The FIG. 6 shows the locking disc 40, the diameter of which corresponds to that of the switching wheel 44. 0' designates the reference line, which, in the starting position of the driver, disc 40 agrees with the reference line 0 according to FIG. 5.

The locking disc 40 shows the release cutouts 92 and 94 which correspond to the driver cutouts 82 and 84 of the shifting wheel 44 according to FIG. 5. Although the first release cutout 92 on its peripheral side is shorter than the first driver cutout 80 in the shifting wheel 44, its flanks 93 and 93' are disposed in the same sense as those of the first driver cutout 80. The flanks 95 and 95' of the second release cutout 94, on the other hand, are disposed opposite to those of the second driver cutout 82.

As has already been mentioned, the locking discs 40, in the case of an apparatus with several couplings, are the only variable components of the couplings. In the case of the locking disc 40 shown in FIG. 6, the release cutout 94 corresponds to the driver cutout 82 of the switching wheel 4. The locking disc 40 may therefore have either only the release cutout 94 or one of the release cutouts 96 or 98 indicated in a broken line and shown by way of example, in order to make possible an engagement of the driver 74 with always one of the driver cutouts 82, 84 or 86 of the shifting wheel 44. Consequently, the predetermined rotational angle for each coupling depends on the arrangement of the corresponding release cutout.

Besides the two release cutouts 92 and 94, the locking disc 40 has on the peripheral side and displaced two driver cutouts 100 and 102 with driver flanks 101 and 101' or 103 and 103', which are steep on both sides.

Figure 7:
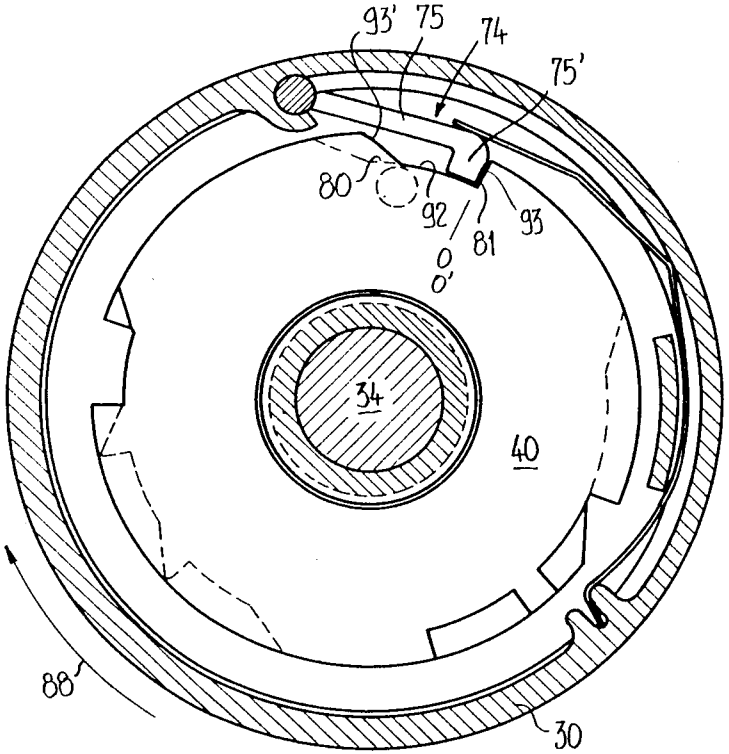
FIG. 7 a functional presentation in the case of the cooperation of the switching wheel with the locking disc, in the starting position.
Figure 10:
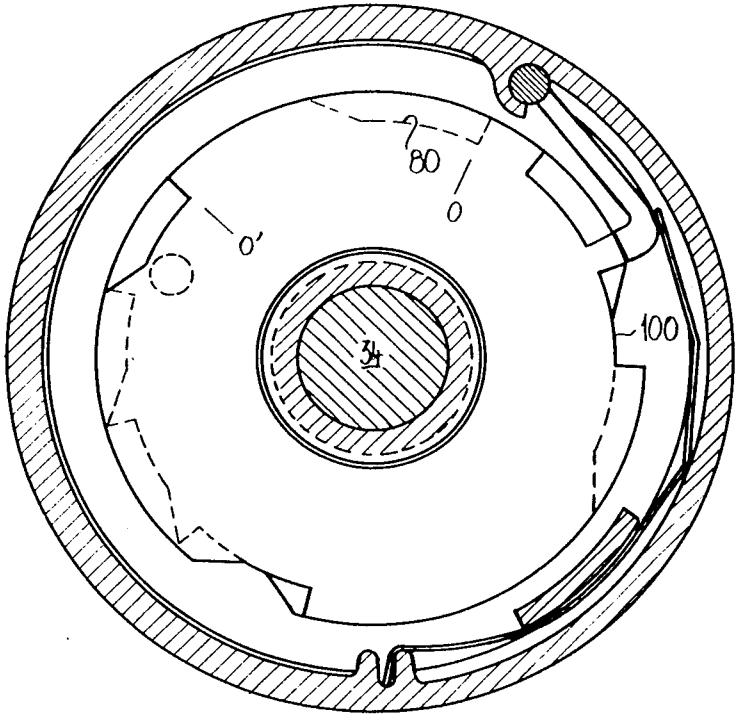
FIG. 10 like FIG. 9, however, after an additional reverse rotation by about 360°.

With reference to FIGS. 7 to 10, the manner of functioning of the coupling will be explained. From these figures, the position of the locking disc 40 is apparent always in relation to the shifting wheel 44. FIG. 7 shows the starting position in which the driver 74 engages with the driver cutout 80 of the shifting wheel 44 freed by the release cutout 92 of the locking disc 40 and in the case of a forward rotation 88 of the gear 30, lies with its driver element 75' close on the driver flank 81 of the driver cutout 80 on wheel 44 as well as on the flank 93 of the release cutout 92. Furthermore, the driver 74 presses with its driver element 75' against the stop surface 60 of the control disc 42 which on its part disengages with its operating arms 72, 72' and 72" the latch arrangement 64 against the action of the springs 70 from the toothing 62 of the hub 38. This is the normal operating position in which the platen 16 according to FIG. 1 may be turned forward as desired without the coupling 12 reacting thereby.

Whenever now the gear 30 with the driver 74 is turned back by a predetermined rotational angle as compared to the starting position shown in FIG. 7, then it is guided out of the driver cutout 80 by the end-flank 93' on disc 40 and engages with the second driver cutout 82 as a result of the freed second release cutout 94. The FIG. 3 shows this position. As a result of the withdrawal of the driver 74, the control disc 42 is released so that the latches 64 will produce the engagement with the toothed recess 62 under the effect of the springs 70. The coupling 12 thus is in its coupled in state and in the case of a renewed forward rotation is now ready to carry along the output shaft 34 in the direction of the arrow 88.

Figure 8:
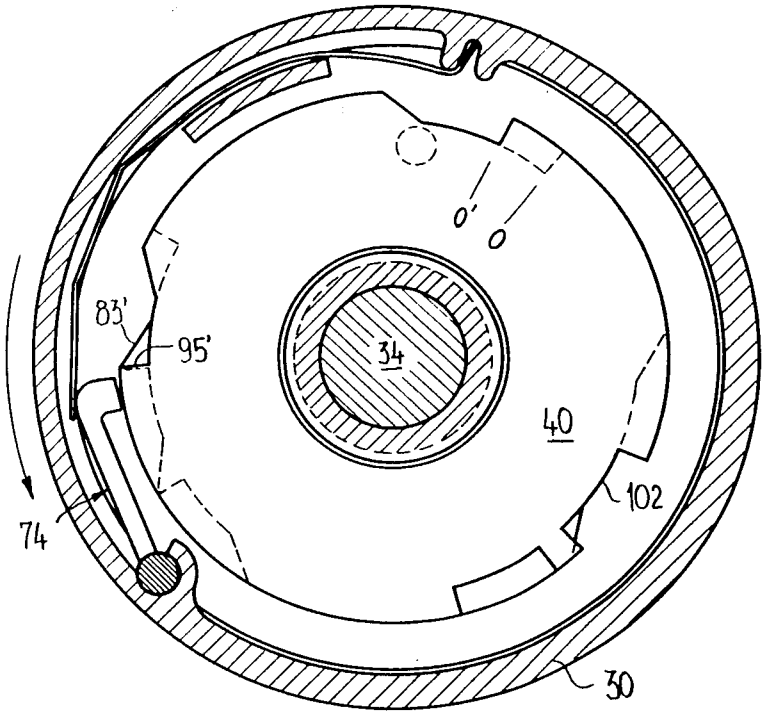

Whenever the gear 30 according to FIG. 8, however, is turned back further than the predetermined rotational angle, then the driver 74 engaging with the cutouts 82 and 94 (FIG. 5, 6) carries along the locking disc 40 in the counterclockwise direction, whereby, engaging at the flank 95' of the locking disc 40, it is guided out of the cutouts 82 and 94 through engagement with the flank 83' of the cutout 82 of switching wheel 44.

Figure 9:
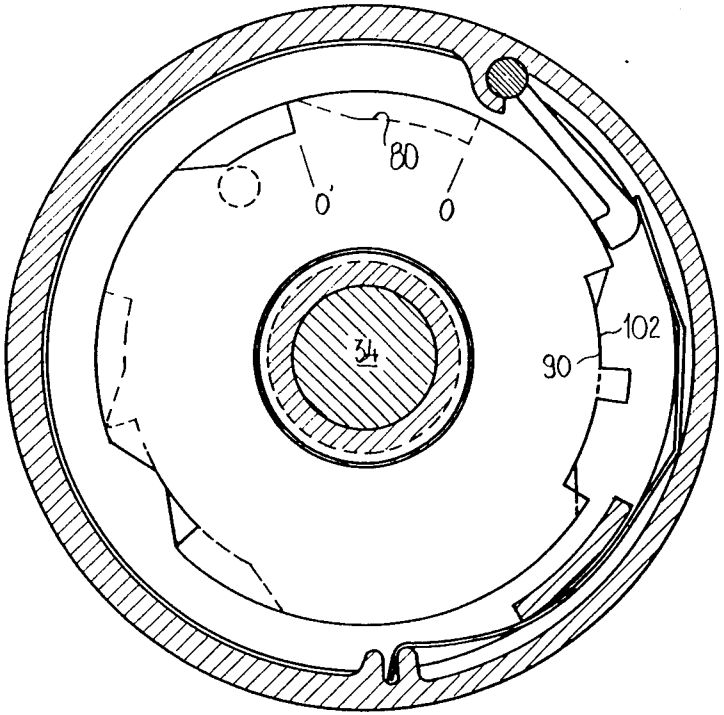
FIG. 9 like FIG. 8, however, after an additional reverse rotation by about 180°.

In the case of a further return rotation of the gear 30, the driver now engages with the cutout 102 in the locking disc 40 in order to turn the latter back by an additional rotational angle according to FIG. 9. From the FIG. 9, one may now recognize clearly that the driver 74 in the case of an additional backward rotation is prevented by the locking disc 40 from engaging with the cutout 80 of the switching wheel 44. After a second rotation, the driver now engages with the indentation 100 of the locking disc in order to turn the latter back by an additional step according to FIG. 10. The driver may now be turned back by almost a complete rotation once more according to FIG. 10, however, it is must not engage now anymore with the cutout 100, since otherwise one rotation will be lost in the case of a subsequent forward rotation. Whenever the driver 74 is rotated from the position shown in FIG. 10 again into a forward direction, then a step by step reverse positioning of the locking disc 40 takes place as a result of engagement with the cutout 100 and after an additional rotation into the cutout 102. After that, a relative position is reestablished which corresponds to FIG. 8. From FIG. 8 it is apparent now that the driver 74 is able to reach its starting position again.

The permissible return rotational angle of the gear 30 without the coupling being coupled in within this range in the case of any given forward and backward movements, corresponds to the length of a sheet to be written on, so that within this range any desired graphic presentations are possible on the platen.

Although the coupling shown in the embodiment by way of example was described by way of an office machine, its use is not limited to an office machine. The coupling may be used everywhere, where a control for coupling in and out is to be established solely by a reversal of the rotational direction and backward rotation by a predetermined rotational angle.

What is claimed is:

1. A coupling apparatus for operation between a platen of a printing device rotatable in forward and reverse directions and a material recording medium carrier of the type having a magazine and a separating device for separating individual recording medium from a stack of media in the magazine, the apparatus comprising a gear means for connection to a rotary output riginating with the platen so as to be rotatable in the same sense as the platen, an output shaft for connection to the separating device, means for transmitting rotation of said gear means to said output shaft, said transmitting means including first disc means having starting means and entrainment means spaced apart from each other by a predetermined rotary angle, said transmitting means further including first movable driver means connected with said gear means and engageable with said starting means and said entrainment means for transmitting rotary motion from said gear means to said first disc means upon rotation of said gear means in the forward direction, said first disc means including second movable driver means for transmitting rotary motion thereof to said shaft with said first driver means being in engagement with said entrainment means, said transmitting means further including shifting means operable upon rotation of said gear means in a reverse direction to move said first driver means out of driving engagement with either one of said starting means or said entrainment means, said transmitting means further including a locking means engageable by said first driver means so as to be rotatable about said shaft in a sense corresponding to the rotation of said gear means and having means for disengaging from driving engagement with said first driving means upon rotation of said gear means in a reverse direction and for rotating said locking means upon reverse rotation of said gear means through an angle that exceeds said predetermined angle so that said first driver means will be prevented from driving engagement with said first disc means; said second driver means including a latch member movably carried by said first disc means and drivingly engaging said shaft upon forward rotation of said first disc means with said first driver means being in engagement with said entrainment means, said first disc means including at least two cam surface means, each said cam surface means having a forward steep portion and a rearward sloping portion relative to said direction of rotation said forward steep portions defining said starting means and said entrainment means, respectively, and said rearward sloping portion defining said shifting means.

2. The apparatus as claimed in claim 1, wherein said second movable driver means includes a latch member movably carried by said first disc means and drivingly engaging said shaft upon forward rotation of the platen through a preselected angle of rotation.

3. The apparatus as claimed in claim 1, wherein said locking means is a disc member having a periphery and said means for disengaging of said locking means comprise two cam surface means located on said periphery thereof in locations correlated to the location of said two cam surface means of said first disc means, one of said cam surface means of said locking means having a rearward steep portion and a forward sloping portion relative to the direction of rotation.

4. The apparatus as claimed in claim 3, wherein said disc member includes two additional cam surface means each located on said periphery at locations circumferentially opposite a corresponding one of said two cam surface means of said locking means, each of said additional cam surface means having steep forward and rearward portions, said first disc means having a third cam surface means located intermediate said two cam surface means thereof and having sloping forward and rearward portions.

5. The apparatus as claimed in claim 1, wherein said means for transmitting includes a control member engageable by said first movable driver means and operable to move said second movable driver means out of engagement with said shaft when said first movable driver means is moved from a reverse position forwardly towards a starting position formed by said starting means of said first disc means.

6. The apparatus as claimed in claim 3, wherein said means for transmitting includes a control member engageable by said first movable driver means and operable to move said second movable driver means out of engagement with said shaft when said first movable driver means is moved from a reverse position forwardly towards a starting position formed by said starting means of said first disc means.

7. The apparatus as claimed in claim 4, wherein said means for transmitting includes a control member engageable by said first movable driver means and operable to move said second movable driver means out of engagement with said shaft when said first movable driver means is moved from a reverse position forwardly towards a starting position formed by said starting means of said first disc means.

8. A coupling apparatus for operation between a platen of a printing device rotatable in forward and reverse directions and a material recording medium carrier of the type having a magazine and a separating device for separating individual recording medium from a stack of media in the magazine, the apparatus comprising a gear means for connection to a rotary output originating with the platen so as to be rotatable in the same sense as the plant, an output shaft for connection to the separating device, means for transmitting rotation of said gear means to said output shaft, said transmitting means including first disc means and first movable driver means connected with said gear means for transmitting rotary motion from said gear means to said first disc means upon rotation of said gear means in the forward direction, said first disc means including second movable driver means for transmitting rotary motion thereof to said shaft, said transmitting means further including shifting means operable upon rotation of said platen in a reverse direction through a predetermined angle to move said fist driver means out of driving engagement with said first disc means, said transmitting means further including a locking means engageable by said first driver means so as to be rotatable about said shaft in a sense corresponding to the rotation of the platen and having means for disengaging from driving engagement with said first driving means upon rotation of said gear means in a reverse direction and for rotating said locking means upon reverse rotation of said gear means through an angle that exceeds said predetermined angle so that said first driver means will be prevented from driving engagement with said first disc means; said second movable driver means comprising three latch members each movably carried by said first disc means and each spaced 120 degrees apart about said shaft from one another, each having an end movable into engagement with gear teeth associated with said shaft, said means for transmitting including a control member mounted about said shaft and movable by said first driver means, said control member including three arm means each for disengaging a said latch member upon rotation of said control member from engagement with said gear teeth, said three arm means being spaced circumferentially apart so that, upon rotation of said control member, only one of said latch members will be in engagement with said gear teeth at any one time.

9. The apparatus as claimed in claim 5, wherein said gear means, said locking means, said control member and said first disc means each include a disc shaped portion rotatably mounted about said shaft, the apparatus including spring means urging said disc shaped portions against one another, a ball bearing race means disposed between said gear means and said locking means, said first disc means including axial extensions extending through said control member, said spring means being operative to establish a frictional engagement between said first disc means and said shaft.

10. The apparatus as claimed in claim 1, wherein said gear means includes external gear teeth and an annular jacket substantially enclosing said means for transmitting.

11. The apparatus as claimed in claim 9, wherein said gear means includes an annular jacket substantially enclosing said locking means, said control member and said first disc means.

12. A coupling apparatus for operation between a platen of a printing device rotatable in forward and reverse directions and a material recording medium carrier of the type having a magazine and a separating device for separating individual recording medium from a stack of media in the magazine, the apparatus comprising a gear means for connection to a rotary output originating with the platen so as to be rotatable in the same sense as the platen, an output shaft for connection to the separating device, means for selectively transmitting rotation of said gear means to said output shaft, said transmitting means including first disc means and first movable dreiver means, said first movable driver means being connected with said gear means, said first disc means including second movable driver means for transmitting rotary motion thereof to said output shaft, said first disc means further defining starting means and entrainment means engageable by said first movable driver means, said transmitting means further including control means operable to control said second movable driver means, said first movable driver means normally engaging said starting means and said control means for permitting rotation of said gear means in a forward direction independent of said output shaft, said transmitting means further including shifting means engageable with said first driver means upon rotation of said gear means in a reverse direction to effect disengagement of said first movable driver means from said starting means and to allow engagement thereof with said entrainment means upon rotation of said gear means in a reverse direction about a predetermined angle with respect to an engagement of said first driver means with said starting means, said predetermined angle being smaller than a full revolution of said first driver means, said control means permitting transmission of rotary motion by said second movable driver means to said output shaft with said first movable driver means engaging said entrainment means, said transmitting means further including a rotatable locking means engageable by said first movable driver means upon rotation of said gear means in a reverse direction out of engagement with said starting means about an angle exceeding said predetermined angle, so that said first driver means will be prevented from driving engagement with said entrainment means until a subsequent rotation of said gear means in a forward direction about an angle identical to the angle traversed in the reverse direction has been completed.

13. The apparatus as claimed in claim 12, wherein said second movable driver means includes a latch member movably carried by said first disc means and drivingly engaging said shaft upon forward rotation of said gear means with said first movable driver means engaging said entrainment means.

14. Apparatus for selective feeding of recording carriers stacked in at least two magazines to the platen of a printing device with each magazine being associated with a separating device coupled to the platen by a coupling apparatus for operation by the platen of the printing device, the platen being rotatable in forward and reverse directions and each coupling apparatus comprising:

a gear means for connection to a rotary output originating with the platen so as to be rotatable in the same sense as the platen, an output shaft for connection to the separating device and defining a rotation axis, means for selectively transmitting forward rotation of said gear means to said output shaft, said transmission means including an input means rotatable about said rotation axis and connected for rotation with said gear means first disc means rotatable about said rotation axis and disc driving means arranged between said input means and said first disc means and defining first and second rotational drive positions of said first disc means relative to said input means for transmitting in both of said drive positions rotary motion from said input means to said first disc means, said second drive position being spaced from said first drive position by a predetermined angle of rotation of said input means relative to said first disc means in the reverse direction, said second drive position being engageable by said disc driving means upon rotation of said input means in the forward direction subsequent to a rotation thereof in the reverse direction about said predetermined angle from said first drive position, said transmitting means further including movable driver means for transmitting rotary motion of said first disc means in the forward direction to said shaft and disabling means cooperating with said movable driver means in said first drive position so as to prevent said movable driver means from transmitting rotary motion of said first disc means to said shaft, said transmitting means further including a locking means rotatable about said rotation axis engageable by said disc driving means upon rotation of said input means in the reverse direction beyond said predetermined angle from said first rotational position so as to prevent said second rotational position from becoming engaged by said disc driving means upon subsequent rotation of said input means in the forward direction, said predetermined angle of rotation between said first and second drive positions being a fraction of a revolution of said input means relative to said first disc means and of different magnitude for each of said coupling apparatus so as to permit selection of a separating device for driving connection with the platen, while permitting movement of the platen in forward and reverse directions independent of any one of the separating devices.

* * * * *